United States Patent [19]

Quelch

[11] 4,365,835

[45] Dec. 28, 1982

[54] CONTOUR BOTTLE CARRIER

[76] Inventor: Albert G. B. Quelch, 5841 Melshire Dr., Dallas, Tex. 75230

[21] Appl. No.: 177,244

[22] Filed: Aug. 11, 1980

[51] Int. Cl.[3] ..... B65D 71/00

[52] U.S. Cl. ..... 294/87.2; 206/150; 206/151; 206/199

[58] Field of Search ..... 294/27 R, 31.2, 33, 294/87 R, 87.2–87.28, 90, 99 R, 86 R, 148, 159, DIG. 2; 206/139, 145, 147, 148, 150, 151, 159, 161, 162, 199, 201, 427, 430, 433; 215/100 A; D9/344

[56] References Cited

U.S. PATENT DOCUMENTS

| | | | |
|---|---|---|---|
| 1,541,672 | 6/1925 | Tulay | 206/199 |
| 1,781,056 | 11/1930 | Elder | 206/139 X |
| 2,693,385 | 11/1954 | Cavalli et al. | 294/87.2 |
| 2,803,487 | 8/1957 | Dalton | 294/87.28 |
| 2,996,329 | 8/1961 | Glazer | 294/87.2 |
| 3,003,805 | 10/1961 | Glazer | 294/87.2 |
| 3,036,853 | 5/1962 | Glazer | 294/87.2 |
| 3,086,805 | 4/1963 | Dardaine et al. | 294/90 X |
| 3,178,217 | 4/1965 | Bargel | 294/90 X |
| 3,250,564 | 5/1966 | Stern et al. | 294/87.2 |
| 3,339,814 | 9/1967 | Carbine | 224/45 |
| 3,443,685 | 5/1969 | Wanderer | 294/87.2 X |
| 3,446,346 | 5/1969 | Burge | 206/151 |
| 3,527,345 | 9/1970 | Iorio | 206/65 |
| 3,633,962 | 1/1972 | Erickson | 294/87.2 |
| 3,751,098 | 8/1973 | Owen | 294/87.2 |
| 3,856,343 | 12/1974 | Muller | 294/99 R |
| 3,871,699 | 3/1975 | Hatfield | 294/87.2 |
| 3,907,105 | 9/1975 | Nowak | 206/203 X |
| 3,951,259 | 4/1976 | Oglesbee | 206/427 X |
| 3,968,914 | 7/1976 | Goncalves | 294/87.2 X |
| 4,022,363 | 5/1977 | Eliassen | 294/87.2 X |
| 4,063,771 | 12/1977 | Calvert | 294/87.2 |
| 4,090,729 | 5/1978 | Erickson | 294/31.2 |
| 4,093,295 | 6/1978 | Erickson | 294/87.2 |
| 4,095,720 | 6/1978 | Delbrouck et al. | 206/427 |
| 4,136,772 | 1/1979 | Mascia et al. | 294/87.2 X |
| 4,159,841 | 7/1979 | Calvert | 294/87.2 |
| 4,192,540 | 3/1980 | Oliff | 294/87.2 |
| 4,235,468 | 11/1980 | Erickson | 294/87.2 |

FOREIGN PATENT DOCUMENTS

| | | | |
|---|---|---|---|
| 2068858 | 8/1971 | France | 294/87.2 |

*Primary Examiner*—Johnny D. Cherry

*Attorney, Agent, or Firm*—Hubbard, Thurman, Turner & Tucker

[57] ABSTRACT

A carrier (10) for supporting a plurality of bottles by their necks includes a frame (12) having a plurality of openings (18) defined by interconnected cylindrical segments (20, 22) for releasably receiving and retaining the bottles. Each opening (18) includes two portions of different widths, with the wider portion being bounded by the smaller cylindrical segments (20) and the narrower slot portion being bounded by the larger cylindrical sections.

16 Claims, 5 Drawing Figures

CONTOUR BOTTLE CARRIER

TECHNICAL FIELD

The present invention relates generally to containers, and more particularly to an improved bottle carrier for supporting a plurality of bottles by their necks.

BACKGROUND ART

In the beverage industry, individual containers of products are typically packaged in groups of six or eight for distribution to the consumer. Returnable bottles, for example, are usually packaged in cartons by which the bottles can be returned later after use. Disposable or non-returnable containers, such as bottles and cans are packaged in carriers which are intended to be used but once, and must therefore be as inexpensive as possible. Since bottles are easily broken, it will be appreciated that bottle carriers must be not only inexpensive but also capable of securely supporting the bottles in such a way that the bottles are readily available for disconnection and consumption.

Such bottle carriers have been available heretofore, but the bottle carriers of the prior art have not been entirely satisfactory in at least two respects. In general, the prior bottle carriers are too expensive for one-time usage, and have not been reliably capable of securely supporting the bottles in the desired relationship. Examples of the bottle carriers of the prior art are shown in U.S. Pat. No. 3,633,962 to Erickson, Nos. 3,036,853 and 2,996,329 to Glazer, and No. 2,803,487 to Dalton, all of which utilize either U-shaped retainer clips or split collars to receive the bottle necks.

A need has thus arisen for a new and improved carrier for releasably retaining a plurality of bottles.

SUMMARY OF INVENTION

The present invention comprises a bottle carrier which overcomes the foregoing and other difficulties associated with the prior art. In accordance with the invention, there is provided a novel bottle carrier which is less expensive to fabricate and which provides better structural support for the bottles therein. The bottle carrier herein comprises a frame with a plurality of bottle neck receivers and a pair of finger openings formed therein. Each bottle neck receiver is comprised of a plurality of interconnected cylindrical segments arranged to define an opening for receiving and retaining a bottle by its neck. The bottle neck receivers are preferably arranged in opposing pairs with the bottle neck receivers at the corners of the carrier oriented diagonally to facilitate disconnection of the bottles therefrom. In the preferred embodiment, a skirt extends downwardly from the frame to stabilize the bottles in the carrier.

BRIEF DESCRIPTION OF DRAWINGS

A more complete understanding of the invention can be had by reference to the following Detailed Description in conjunction with the accompanying Drawings, wherein.

DETAILED DESCRIPTION

Figure 1:
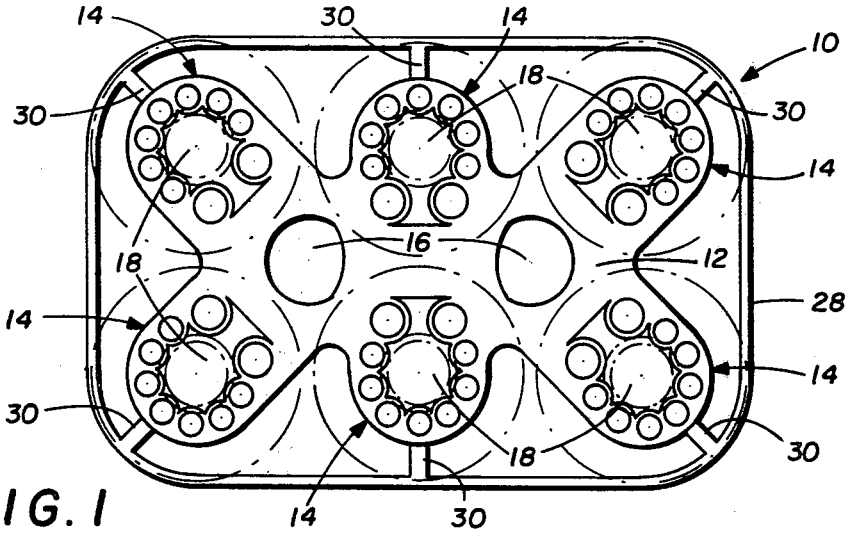
FIG. 1 is a top view of a bottle carrier incorporating the invention.

Referring now to the Drawings, wherein like reference numerals designate corresponding elements throughout the views, and particularly referring to FIG. 1, there is shown the bottle carrier 10 of the invention. Bottle carrier 10 is adapted to carry a plurality of bottles, which are shown in phantom lines, in releasable interlocked engagement, and is also adapted for manufacture by means of conventional injection molding techniques utilizing plastic such as high density polyethylene or other suitable materials. Although carrier 10 is shown in the six-pack embodiment, it will be appreciated that the invention can be configured to carry any number of bottles.

Bottle carrier 10 comprises a generally flat frame 12 having a plurality of bottle receivers 14 integrally formed therein in spaced apart relationship. A pair of optional finger openings 16 are provided in frame 12 to facilitate handling of carrier 10. The bottle receivers 14 are arranged in opposing pairs, and the corner receivers are preferably oriented diagonally to facilitate disconnection of the bottles from the carrier. As will be explained more fully hereinafter, each bottle receiver 14 defines a generally keyhole-shaped opening 18 for releasably receiving and retaining a bottle.

Figure 3:
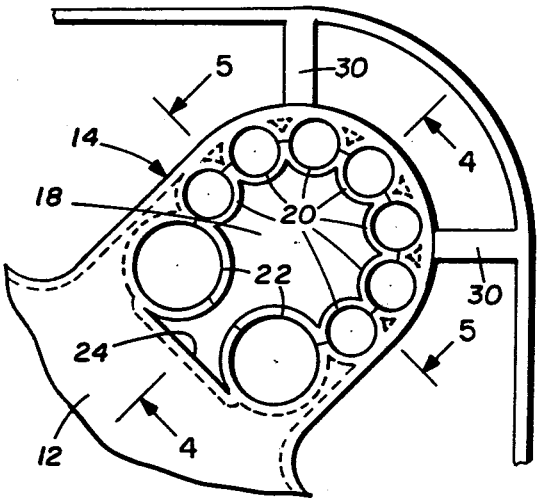
FIG. 3 is an enlarged view of a portion of the bottle carrier showing further details of a typical bottle neck receiver therein.
Figure 4:
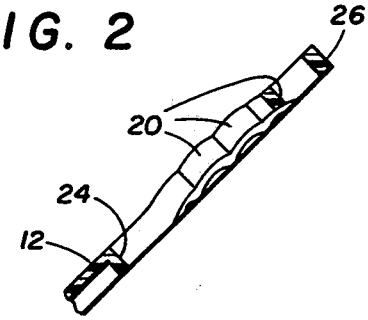
FIGS. 4 and 5 are sectional views taken along lines 4 and 5, respectively, of FIG. 3 in the direction of the arrows.
Figure 5:
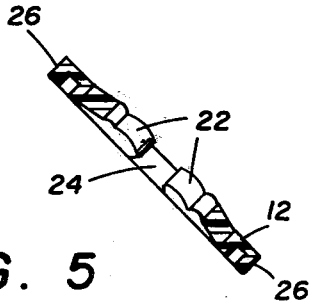

The constructional details of a typical bottle receiver 14 in carrier 10 are shown in FIGS. 3–5. The opening 18 of each receiver 14 is defined by a plurality of interconnected cylindrical segments 20 and 22. The relatively smaller cylindrical segments 20 define the major or wide portion of opening 18, while the relatively larger cylindrical segments 22 define the minor or narrow portion of the opening. In the preferred embodiment, as is best shown in FIGS. 4 and 5, the top and bottom inner portions of the cylindrical segments 20 and 22 bordering opening 18 are angled upwardly to facilitate insertion of a bottle and resist disconnection after insertion. Cylindrical segments 22 are interconnected by a flange or rib 24 to close the narrow portion of opening 18. If desired, a flange 26 can be provided around the entire periphery of frame 12 to lend additional rigidity to carrier 10.

The structure defining each opening 18 comprises a significant feature of the invention. Due to their relative sizes, cylindrical segments 20 are more rigid than cylindrical segments 22. The larger cylindrical segments 22 yield to allow insertion of a bottle, and then resiliently urge the bottle against the smaller cylindrical segments 20 which also deform slightly to accommodate the bottle. The neck of the bottle is thus engaged securely between the resilient cylindrical segments 20 and 22. To effect removal, the lower portion of a bottle is pulled outwardly thereby deforming cylindrical segments 20 and 22 so that the bottle can be disconnected from carrier 10.

Figure 2:
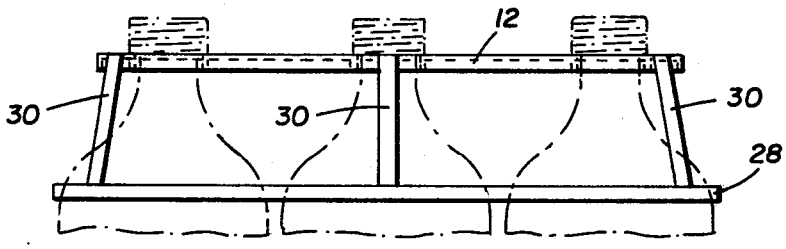
FIG. 2 is an elevational view of the bottle carrier shown in FIG. 1, with the bottles therein shown in phantom lines.

Referring again to FIGS. 1 and 2, bottle carrier 10 further includes an optional skirt 28 connected to frame 12 by a plurality of fingers 30 for stabilizing the bottles therein. The generally rectangular skirt 28 is adapted to surroundingly engage the bodies of the bottles, and may be desirable in some instances; however, it will be understood that the use of skirt 28 with bottle carrier 10 is optional.

From the foregoing, it will be apparent that the present invention comprises an improved bottle carrier having several advantages over the prior art. The bottle carrier herein can be fabricated as an integral unit, and employs unique bottle receiving structure adapted to positively retain the bottles with greater reliability. Other advantages will suggest themselves to those skilled in the art.

Although particular embodiments of the invention have been illustrated in the accompanying Drawing and described in the foregoing Detailed Description, it will be understood that the invention is not limited only to the embodiments disclosed, but is intended to embrace any alternatives, equivalents, modifications and rearrangements of elements falling within the scope of the invention as defined by the following claims.

I claim:

1. A bottle carrier comprising:

a frame;

a plurality of predetermined openings within said frame defined by a plurality of substantially cylindrical segments adapted to releasably receive and retain a bottle by its neck, each of said openings including a wide portion and a narrow slot portion;

the cylindrical segments bounding said wide portion being relatively smaller in diameter than the cylindrical segments bounding said narrow slot portion.

2. The bottle carrier of claim 1 wherein said openings are arranged in opposing lateral pairs with the end-most pairs being oriented diagonally to facilitate removal of the bottles.

3. The bottle carrier of claim 1 wherein said substantially cylindrical segments defining said openings have upper and lower surfaces which are angled relative to said frame to facilitate insertion and enhance retention of said bottles.

4. The bottle carrier of claim 1 wherein said frame further includes a pair of finger openings to facilitate handling of the carrier.

5. The bottle carrier of claim 1 further including:

a skirt positioned in spaced relationship with said frame and adapted to surroundingly engage the bottles; and means for interconnecting said skirt and frame.

6. Apparatus for carrying a plurality of bottles, which comprises:

a generally flat frame;

said frame including a plurality of predetermined openings arranged in opposing spaced apart pairs therein, each opening being defined by a plurality of substantially cylindrical segments adapted to releasably receive and retain a bottle by its neck, each of said openings including a wide portion and a narrow slot portion;

the cylindrical segments bounding said wide portion being relatively smaller in diameter than the cylindrical segments bounding said narrow slot portion; and said frame further including a pair of spaced apart finger openings to facilitate handling of said apparatus.

7. The apparatus of claim 6 wherein the end-most pairs of openings are oriented diagonally to facilitate removal of the bottles therefrom.

8. The apparatus of claim 6 wherein said substantially cylindrical segments defining said openings have upper and lower end surfaces which are angled relative to said frame to facilitate insertion and enhance retention of the bottles.

9. The apparatus of claim 6, including:

a skirt positioned in spaced relationship with said frame and adapted to surroundingly engage the bottles; and means for interconnecting said skirt and frame.

10. A bottle carrier, which comprises:

a generally flat frame;

said frame including a plurality of predetermined openings arranged in opposed lateral pairs therein, each opening being defined by a plurality of substantially cylindrical segments adapted to releasably receive and retain the neck of a bottle, each of said openings including a wide portion and a narrow slot portion;

the cylindrical segments bounding said wide portion being relatively smaller in diameter than the cylindrical segments bounding said narrow slot portion;

the end-most pairs of openings being oriented diagonally to facilitate removal of the bottles;

said frame further including a pair of finger openings to facilitate manual handling of the carrier;

a skirt positioned in spaced relationship with said frame and adapted to surroundingly engage the bottles; and means for interconnecting said skirt and frame.

11. The bottle carrier of claim 10, wherein said substantially cylindrical segments defining said openings have upper and lower surfaces which are angled relative to said frame to facilitate insertion and enhance retention of said bottles.

12. A bottle carrier comprising:

a frame; and a plurality of predetermined openings within said frame defined by a plurality of substantially cylindrical segments adapted to releasably receive and retain a bottle by its neck, each of said openings including a wide portion and a narrow portion, said narrow portion being formed by at least two of said cylindrical segments extending inwardly from nonadjacent points on the periphery of each of said predetermined openings.

13. The bottle carrier according to claim 12 wherein said substantially cylindrical segments are of substantially uniform height.

14. The bottle carrier of claim 12 wherein said frame further includes a pair of spaced apart finger openings to facilitate handling of the carrier.

15. A bottle carrier comprising:

a generally flat frame; and a plurality of openings within said frame defined by a plurality of closed arcuate segments adapted to releasably receive and retain a bottle by its neck, said openings being disposed in opposing lateral pairs with the end-most pairs being oriented diagonally to facilitate removal of the bottles, each of said openings including a wide portion and a narrow portion, said narrow portion being formed by at least two of said closed arcuate segments extending inwardly from nonadjacent points on the periphery of each of said openings.

16. The bottle carrier of claim 15 wherein said frame further includes a pair of finger openings to facilitate handling of the carrier.

* * * * *